US012473135B1

(12) United States Patent
Yang

(10) Patent No.: US 12,473,135 B1
(45) Date of Patent: Nov. 18, 2025

(54) WATER BOTTLE

(71) Applicant: Beijing Shuimujin Technology Co., Ltd., Beijing (CN)

(72) Inventor: Yang Yang, Beijing (CN)

(73) Assignee: Beijing Shuimujin Technology Co., Ltd., Beijing (CN)

( * ) Notice: Subject to any disclaimer, the term of this patent is extended or adjusted under 35 U.S.C. 154(b) by 0 days.

(21) Appl. No.: 19/215,683

(22) Filed: May 22, 2025

(51) Int. Cl.
*B65D 47/06* (2006.01)
*B65D 47/08* (2006.01)
*B65D 81/32* (2006.01)

(52) U.S. Cl.
CPC ..... *B65D 81/3205* (2013.01); *B65D 47/08* (2013.01)

(58) Field of Classification Search
CPC ..... B65D 81/3205; B65D 81/3841; B65D 2543/00046; B65D 47/065; A47J 41/00; A47J 41/0077
USPC ..... 222/129, 533, 131, 534; 215/12.1, 10; 220/592.17
See application file for complete search history.

(56) References Cited

U.S. PATENT DOCUMENTS 2,076,549 A * 4/1937 Conner ..... A45D 40/0068 215/382
6,308,846 B1 * 10/2001 Muller ..... B65D 23/0885 220/592.27
6,405,892 B1 * 6/2002 Volan ..... A47G 19/2288 220/592.17
6,629,618 B1 * 10/2003 Volan ..... A47G 19/2288 220/592.17
8,672,174 B1 * 3/2014 McMullin ..... B65D 47/305 222/533
9,650,189 B1 * 5/2017 Lawson ..... B65D 47/12
D807,692 S * 1/2018 Yao ..... D9/449
10,159,368 B2 * 12/2018 Lin ..... B65D 43/16
11,390,432 B2 * 7/2022 Li ..... F16C 11/045
11,535,441 B2 * 12/2022 Chen ..... B65D 77/0493
12,178,338 B1 * 12/2024 Huang ..... A47G 19/2272
2012/0305559 A1 * 12/2012 Steininger ..... B65D 51/1672 220/259.2
2018/0086519 A1 * 3/2018 Giuliano ..... B65D 25/082
2018/0099805 A1 * 4/2018 Johnson ..... B65D 81/3205
2023/0009929 A1 * 1/2023 Arnell ..... A47G 19/2205
2024/0423235 A1 * 12/2024 Savage ..... B65D 43/0229

* cited by examiner

*Primary Examiner* — Charles P. Cheyney
(74) *Attorney, Agent, or Firm* — Zhigang Ma

(57) ABSTRACT

A water bottle includes a first bottle component, at least one second bottle component assembled with the first bottle component in a nested manner, and a locking mechanism disposed between the first bottle component and the at least one second bottle component. The locking mechanism is configured to lock or unlock the first bottle component to the at least one second bottle component. The water bottle can be used in different scenarios, especially when the water bottle is in a separate structure, it can be used by multiple people.

4 Claims, 6 Drawing Sheets

WATER BOTTLE

TECHNICAL FIELD

The disclosure relates to the field of life utensils, and particularly to a water bottle.

BACKGROUND

In daily life, as a common drinking utensil, a water bottle is designed with a focus on portability and practicality. However, traditional water bottles often lack flexibility in design and are difficult to adapt to diverse needs in different usage scenarios. Especially when multiple people share drinking or need to meet portability requirements, the design of the existing water bottles seems inflexible and inconvenient.

SUMMARY

The disclosure provides a water bottle that users can flexibly choose to use in the form of a combination or a separate structure according to specific usage scenarios and needs.

The water bottle includes a first bottle component, at least one second bottle component, and a locking mechanism. The second bottle component is assembled with the first bottle component in a nested manner, and the locking mechanism is disposed between the first bottle component and the second bottle component. The locking mechanism is configured to lock or unlock the first bottle component to the second bottle component, thereby forming a combination structure or a separate structure between the first bottle component and the second bottle component.

In an embodiment, the locking mechanism includes a first thread structure and a second thread structure. The first thread structure is disposed on an outer side of the first bottle component, and the second thread structure is disposed on an inner side of the second bottle component corresponding to a position of the first thread structure, and threadedly cooperating with the first thread structure.

In an embodiment, the first bottle component includes a bottle body and a bottle cover disposed on a top of the bottle body.

In an embodiment, the bottle cover is a flip structure.

In an embodiment, the bottle cover includes a bottle cover body and a suction nozzle. A top of the bottle cover body defines an accommodating cavity. The suction nozzle is rotatably assembled inside the accommodating cavity, the suction nozzle is a hollow structure, and a tail of the suction nozzle is connected to a drinking straw disposed inside the bottle body.

In an embodiment, the water bottle further includes a pressing plate, and the pressing plate is rotatably connected to the bottle cover. An end of the pressing plate is rotatably connected to the suction nozzle, and another end of the pressing plate is detachably connected to an inner wall of the accommodating cavity. When the pressing plate flips towards a direction close to the accommodating cavity, the pressing plate is configured to push the suction nozzle to flip into the accommodating cavity. A buckle component is disposed between the pressing plate and the accommodating cavity, and the buckle component is configured to lock the pressing plate to the bottle cover.

In an embodiment, a supporting plate is disposed on a corresponding position of the suction nozzle connected to the pressing plate, and the supporting plate is configured to support the pressing plate; the supporting plate is provided with a limiting block, the pressing plate defines a first limiting slot and a second limiting slot at intervals, and each of the first limiting slot and the second limiting slot is matched with the limit block. The first limiting slot is configured to fix the pressing plate when the suction nozzle rotates out of the accommodating cavity, thereby staggering the pressing plate with the suction nozzle, and the second limiting slot is configured to fix the pressing plate when the suction nozzle rotates into the accommodating cavity, thereby making the pressing plate overlap with the suction nozzle.

In an embodiment, a protrusion is disposed on a side of the suction nozzle facing towards a bottom of the accommodating cavity, and the bottom of the accommodating cavity defines a through hole connected to the bottle body. A silicone pad is disposed in the through hole, and the silicone pad defines a pressure relief hole matched with the protrusion.

In an embodiment, a bottom of the second bottle component is provided with a detachable silicone fitting ring, a side wall of the silicone fitting ring is provided with a locking piece matched with both the bottom and a top of the second bottle component. When the silicone fitting ring is disposed on the bottom of the second bottle component, the silicone fitting ring is configured to be a base of the second bottle component. When the silicone fitting ring is disposed on the top of the second bottle component, the detachable silicone fitting ring is configured to be a bottle mouth protective ring of the second bottle component.

In an embodiment, the locking piece is a third thread structure disposed on an outer side of the silicone fitting ring, the third threaded structure is matched with a fourth thread structure disposed on an inner side of the bottom of the second bottle component, and the third threaded structure is matched with a fifth thread structure disposed on an inner side of the top of the second bottle component.

The water bottle is provided, which includes a first bottle component, at least one second bottle component, and a locking mechanism. The second bottle component is assembled with the first bottle component in a nested manner, and the locking mechanism is disposed between the first bottle component and the second bottle component. The locking mechanism is configured to lock or unlock the first bottle component to the second bottle component, thereby forming a combination structure or a separate structure between the first bottle component and the second bottle component. By improving conventional water bottle, a combined structure including the first and second bottle components is obtained. Through the locking mechanism disposed between the first bottle component and the second bottle component, the water bottle can be used in a form of a combination or a separate structure according to user needs, thereby making users use the water bottle in different scenarios. Especially when the water bottle is in the form of a separate structure, it can be used by multiple people, and in scenarios where multiple people do not need to use it, the water bottle can be adjusted to the form of a combination structure, thereby achieving a portable effect of the water bottle.

BRIEF DESCRIPTION OF DRAWINGS

Combining with attached drawings, a detailed description of the specific embodiment of the disclosure will make the technical solution and other beneficial effects of the disclosure apparent.

Figure 1:
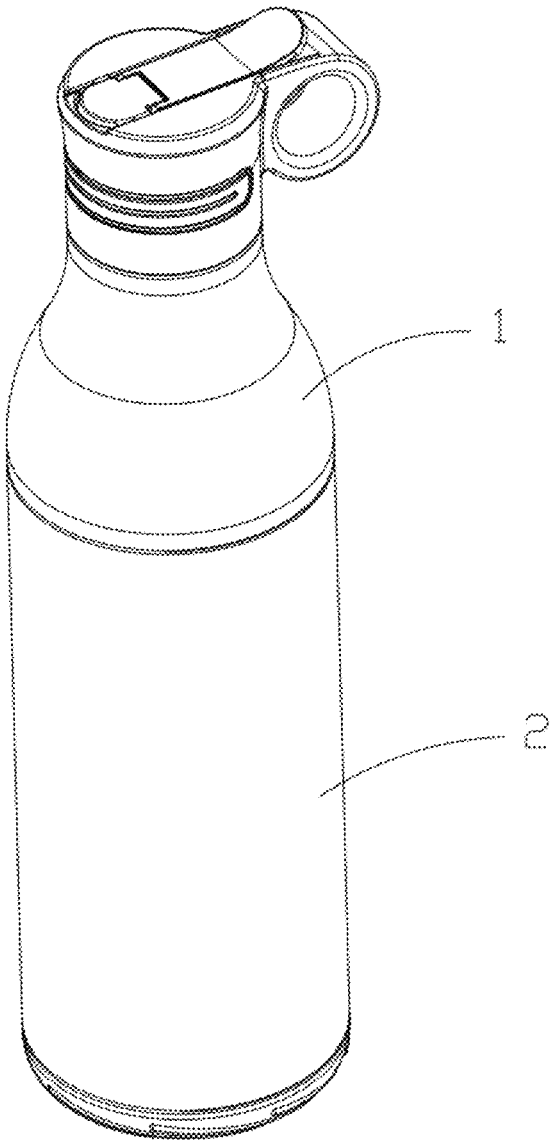
FIG. 1 illustrates an overall schematic structural diagram of a water bottle in an embodiment of the disclosure.

In attached drawings, description of reference signs is listed as follows:

1. first bottle component; 11. bottle body; 12. bottle cover; 121. bottle cover body; 122. accommodating cavity; 123. suction nozzle; 2. second bottle component; 3. locking mechanism; 31. first thread structure; 32. second thread structure; 4. pressing plate; 5. supporting plate; 6. limiting block; 7. first limiting slot; 8. second limiting slot; 9. protrusion; 10. pressure relief hole; 13. silicone fitting ring; 14. locking piece; 141. third thread structure; 15. buckle component; 151. buckle; 152. buckle slot; 20. through hole; 30. silicone pad; 40. drinking straw.

DETAILED DESCRIPTION OF EMBODIMENTS

The following will provide a clear and complete description of the technical solution in the embodiments of the disclosure, in conjunction with the attached drawings. Apparently, the described embodiments are only a part of the embodiments of the disclosure, not all of them. Based on the embodiments of the disclosure, all other embodiments obtained by those skilled in the art without creative labor are within the scope of protection of the disclosure.

In the description of the disclosure, it should be understood that the terms "center", "longitudinal", "lateral", "length", "width", "thickness", "up", "down", "front", "rear", "left", "right", "vertical", "horizontal", "top", "bottom", "inner", "outer", "clockwise", "counterclockwise", etc., which indicate orientation or positional relationships, are based on the orientation or positional relationships shown in the attached drawings. These terms are used merely for the convenience of description and to simplify the description, and do not indicate or imply that the device or component referred to must have a specific orientation, be constructed and operated in a specific orientation. Therefore, they should not be construed as limiting the disclosure. In addition, the terms "first" and "second" are used for descriptive purposes only and should not be construed as indicating or implying relative importance or as implicitly specifying the quantity of the technical features indicated. Accordingly, features defined by "first" and "second" may explicitly or implicitly include one or more of the features. In the description of the disclosure, the term "multiple" means two or more, unless otherwise specifically limited.

In the description of the disclosure, it should be noted that unless otherwise expressly specified and defined, the terms "mount", "connect", and "link" should be broadly understood. For example, they may refer to fixed connections, detachable connections, or integral connections, they may refer to mechanical connections, electrical connections, or connections that allow for communication between components, they may refer to direct connections or indirect connections through intermediate media, or they may refer to the interrelationship or internal connection between two components. For those skilled in the art, the specific meanings of the above terms in the disclosure can be understood in accordance with the specific circumstances.

In the disclosure, unless otherwise expressly specified and defined, the first feature being "above" or "below" the second feature may include the first and second features being in direct contact, or it may include the first and second features not being in direct contact but being in contact through additional features therebetween. Moreover, the first feature being "on", "above", or "over" the second feature includes the first feature being directly above or diagonally above the second feature, or simply indicates that the first feature has a higher horizontal level than the second feature. The first feature being "under", "below", or "beneath" the second feature includes the first feature being directly below or diagonally below the second feature, or simply indicates that the first feature has a lower horizontal level than the second feature.

The disclosure in the following text provides many different embodiments or examples for implementing the various structures of the disclosure. In order to simplify the disclosure, components and settings of specific examples are described in the following text. Of course, they are merely examples and are not intended to limit the disclosure. In addition, the disclosure may repeat reference numerals and/or reference letters in different examples, which is for the purpose of simplification and clarity and does not in itself indicate a relationship between the various embodiments and/or settings discussed. Moreover, the disclosure provides various specific examples of processes and materials, but those skilled in the art can be aware of the disclosure of other processes and/or the use of other materials.

Figure 2:
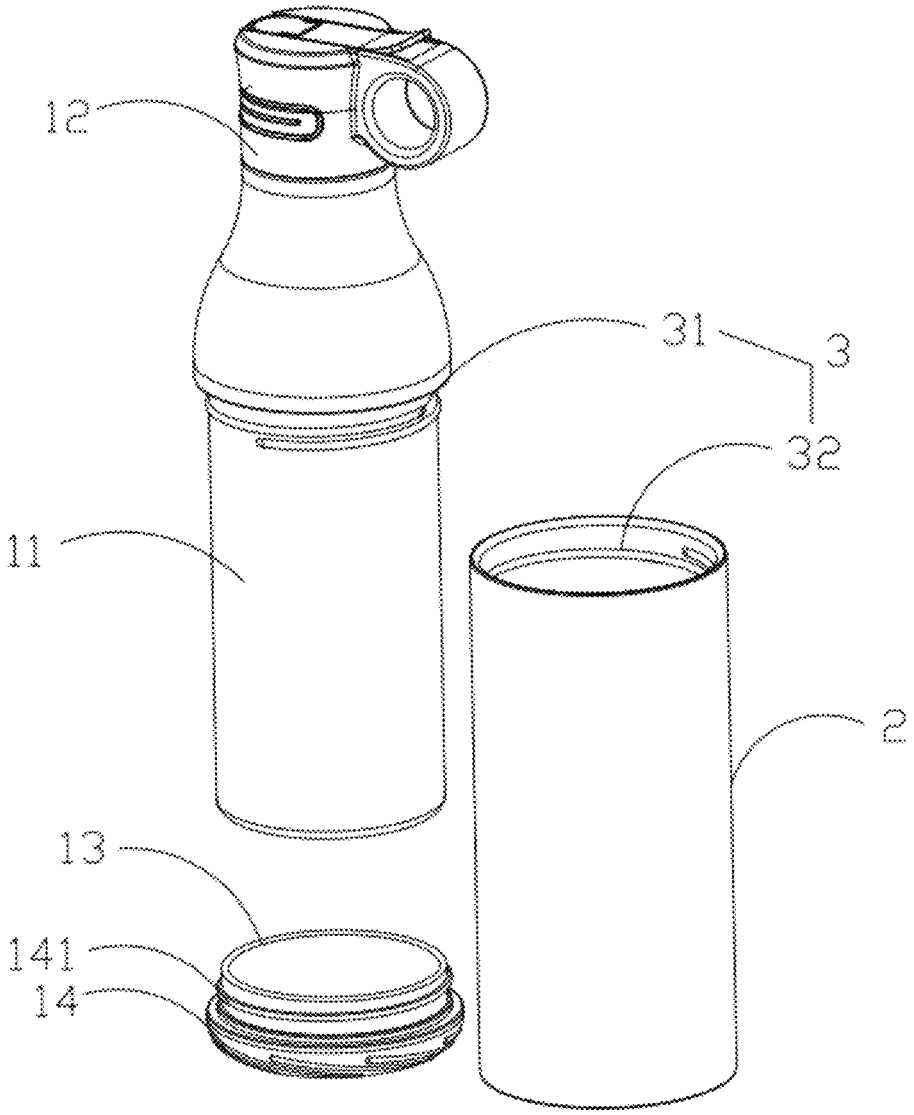
FIG. 2 illustrates an exploded schematic structural diagram of the water bottle in the embodiment of the disclosure.
Figure 3:
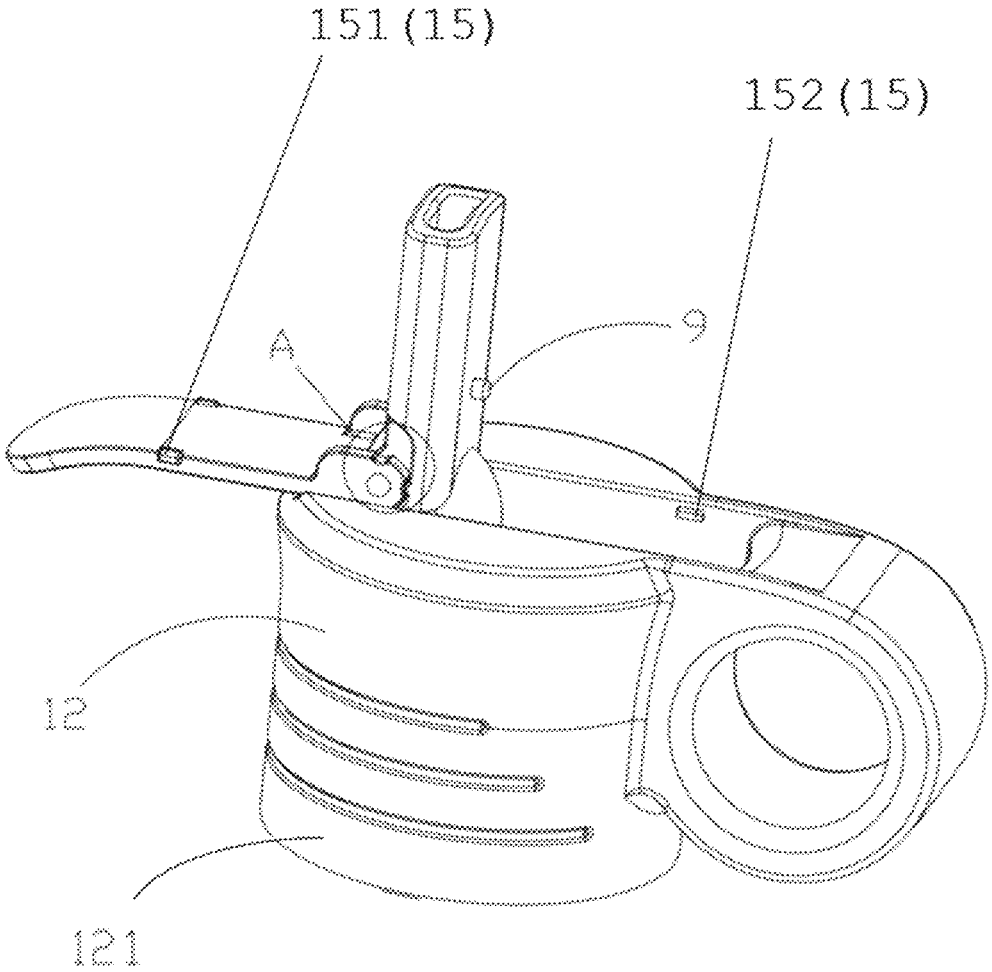
FIG. 3 illustrates a schematic structural diagram of a suction nozzle of the water bottle in the embodiment of the disclosure.
Figure 4:
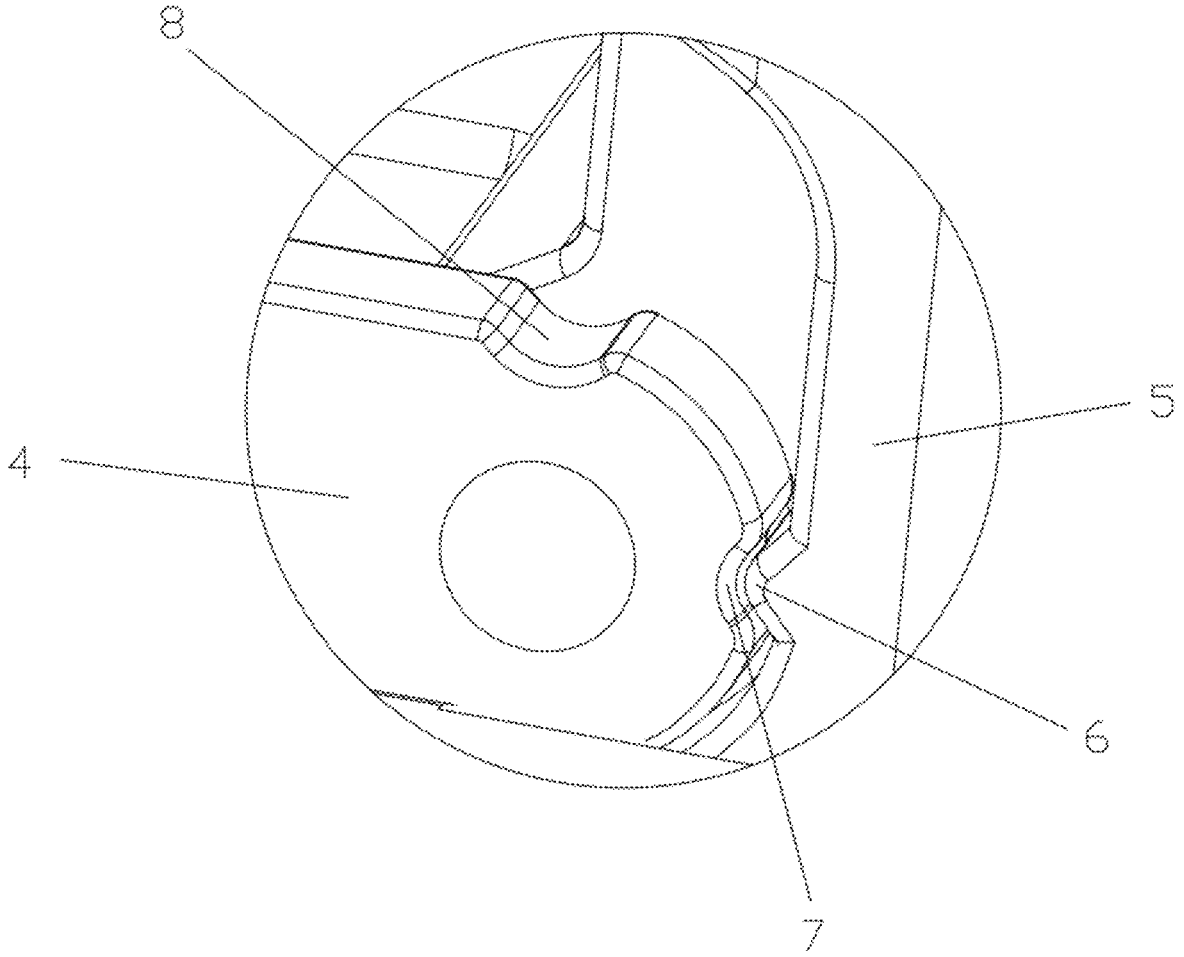
FIG. 4 illustrates an enlarged schematic diagram of portion A illustrated in FIG. 3.
Figure 5:
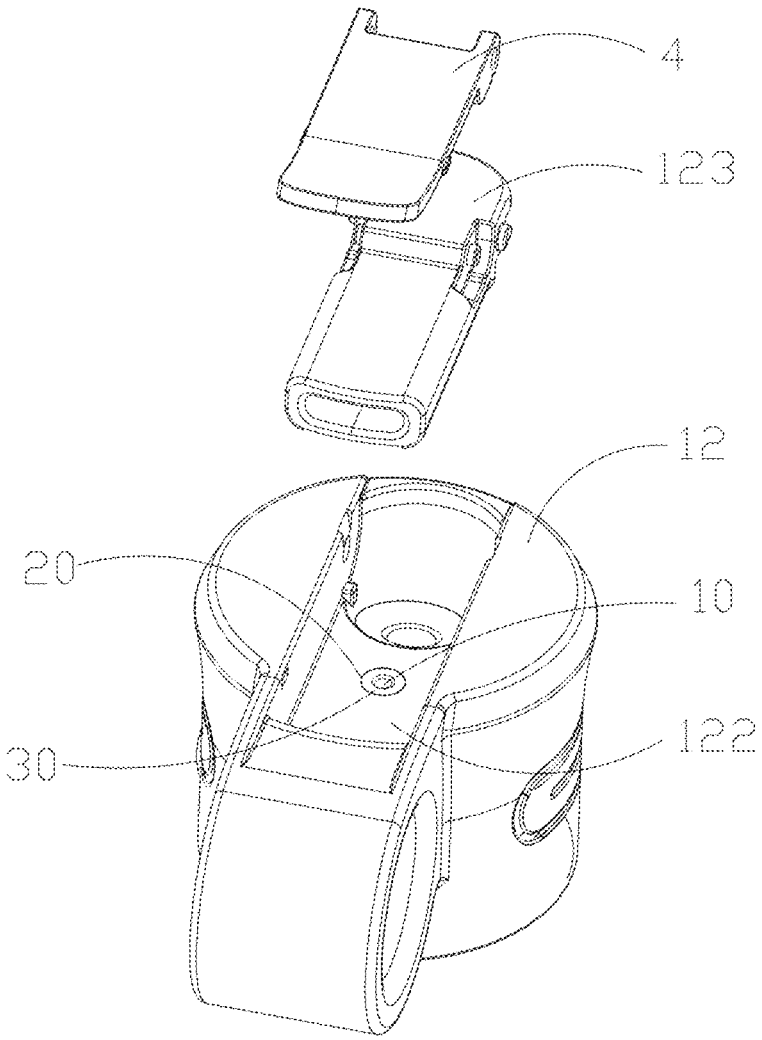
FIG. 5 illustrates an exploded schematic structural diagram of a bottle cover of the water bottle in the embodiment of the disclosure.
Figure 6:
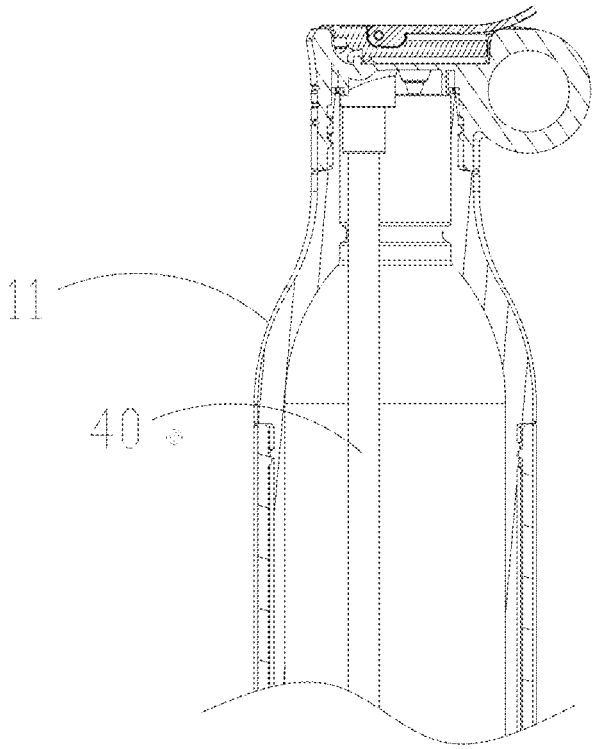
FIG. 6 illustrates a schematic structural diagram of a drinking straw of the water bottle in the embodiment of the disclosure.

In an embodiment, a water bottle is provided. As shown in FIGS. 1 to 6, the water bottle includes a first bottle component 1, at least one second bottle component 2, and a locking mechanism 3. The second bottle component 2 is assembled with the first bottle component 1 in a nested manner, and the locking mechanism 3 is disposed between the first bottle component 1 and the second bottle component 2. The locking mechanism 3 is configured to lock or unlock the first bottle component 1 to the second bottle component 2, thereby forming a combination structure or a separate structure between the first bottle component 1 and the second bottle component 2.

In the embodiment, the water bottle mainly includes a first bottle component 1, at least one second bottle component 2, and a locking mechanism 3. The first bottle component 1 is assembled with the second bottle component 2 in a nested manner, and the locking mechanism 3 is configured to lock or unlock the first bottle component 1 to the second bottle component 2. This allows the water bottle to form a combination structure or a separate structure. It can be used as an integrated unit or as separate units, thus meeting the portability requirement while allowing multiple people to use it, highlighting the practicality of the water bottle.

It should be noted that the second bottle component 2 can be one or more in number, and the quantity of the nested components can be designed according to actual needs, with no specific limitation herein.

In an embodiment, the locking mechanism 3 includes a first threaded structure 31 and a second thread structure 32, the first threaded structure 31 is disposed on an outer side of the first bottle component 1, and the second threaded structure 32 is disposed on an inner side of the second bottle component 2 corresponding to a position of the first thread structure 31, and threadedly cooperating with the first thread structure 31. When it is necessary to transform the water bottle into the separate structure, simply unscrew the first bottle component 1 and the second bottle component 2 in opposite directions to separate them, thereby obtaining two bottle that can be used simultaneously, which meets the needs of multiple people using the water bottle. When it is necessary to transform the water bottle back into a combination structure, simply nest the first bottle component 1 with the second bottle component 2 and then screw them together.

It should be noted that when the water bottle is in the separate structure, an entire beverage can be placed in the second bottle component 2, which has a larger accommodation space, and can be used as a refrigeration can. The second bottle component 2 can also be used for brewing beverage bags, and the accommodating cavity can serve as a brewing cavity.

In an embodiment, the first bottle component 1 includes a bottle body 11 and a bottle cover 12 disposed on a top of the bottle body 11. By designing a bottle cover 12 for the first bottle component 1 disposed inside the second bottle component 2, which keeps the liquid or other objects inside the first bottle component 1 warm, prevent contamination, and avoid spillage.

In an embodiment, the bottle cover 12 is a flip structure. By designing the bottle cover 12 as the flip structure, the convenience for users when opening and closing the bottle cover 12 can be enhanced. It can be understood that, in addition to being designed as the flip structure, the bottle cover 12 can also be designed as a screw-on structure, a slide structure, or other common types of bottle cover opening and closing structures, with no specific limitation herein.

In an embodiment, the bottle cover 12 includes a bottle cover body 121 and a suction nozzle 123, a top of the bottle cover body 121 defines an accommodating cavity 122, and the suction nozzle 123 is rotatably assembled inside the accommodating cavity 122. The suction nozzle 123 is a hollow structure, and a tail of the suction nozzle 123 is connected to a drinking straw 40 disposed inside the bottle body 11. By designing the rotatable suction nozzle 123 and connecting it to the drinking straw 40 disposed inside the bottle body 11, users can drink the liquid inside the bottle body 11 through the suction nozzle 123. When the suction nozzle 123 is not in use, it can be rotated into the accommodating cavity 122 for storage.

In an embodiment, the water bottle further includes a pressing plate 4, which is rotatably connected to the bottle cover 12. An end of the pressing plate 4 is rotatably connected to the suction nozzle 123, and another end of the pressing plate 4 is detachably connected to an inner wall of the accommodating cavity 122. When the pressing plate 4 flips towards a direction close to the accommodating cavity 122, the pressing plate 4 can push the suction nozzle 123 to flip into the accommodating cavity 122. A buckle component 15 is disposed between the pressing plate 4 and the accommodating cavity 122, and the buckle component 15 is configured to lock the pressing plate 4 to the bottle cover 12. By designing the pressing plate 4 above the suction nozzle 123 and providing the buckle component 15 between the pressing plate 4 and the accommodating cavity 122 that can lock the pressing plate 4 to the bottle cover 12, the suction nozzle 123 can be indirectly pushed into the accommodating cavity 122 by the pressing plate 4 when it is not in use. The pressing plate 4 and the suction nozzle 123 can then be fixed to the bottle cover 12 by the buckle component 15. It should be explained that the buckle component 15 mainly includes a buckle 151 and a buckle slot 152, which are respectively disposed on an outer side of the pressing plate 4 and the inner side of the accommodating cavity 122. The fixing or unfixing is achieved by a cooperation of the buckle 151 and the buckle slot 152.

In an embodiment, a supporting plate 5 is disposed on a corresponding position of the suction nozzle 123 connected to the pressing plate 4, the supporting plate 5 is configured to support the pressing plate 4, and the supporting plate 5 is provided with a limiting block 6. The pressing plate 4 defines a first limiting slot 7 and a second limiting slot 8 at intervals, and each of the first limiting slot and the second limiting slot is matched with the limiting block 6. The first limiting slot 7 is configured to fix the pressing plate 4 when the suction nozzle 123 rotates out of the accommodating cavity 122, thereby staggering the pressing plate 4 with the suction nozzle 123. The second limiting slot 8 is configured to fix the pressing plate 4 when the suction nozzle 123 rotates into the accommodating cavity 122, thereby making the pressing plate 4 overlap with the suction nozzle 123. By setting each of the first limiting slot 7 and the second limiting slot 8 corresponding to the limiting block 6, and positions and functions of the first limiting slot 7 and the second limiting slot 8 are different, the first limiting slot 7 can limit the limiting block 6 when the suction nozzle 123 rotates out of the accommodating cavity 122, so that the pressing plate 4 is staggered with the suction nozzle 123, and thus the pressing plate 4 does not affect the use of the suction nozzle 123 for users. When the suction nozzle 123 rotates into the accommodating cavity 122, the second limiting slot 8 limits the limiting block 6, so that the pressing plate 4 overlaps with the suction nozzle 123, thereby further restricting the suction nozzle 123 from rotating out of the accommodating cavity 122.

In an embodiment, a protrusion 9 is disposed on a side of the suction nozzle 123 facing towards the bottom of the accommodating cavity 122. The bottom of the accommodating cavity 122 defines a through hole 20 connected to the bottle body 11. A silicone pad 30 is disposed in the through hole 20, and the silicone pad 30 defines a pressure relief hole 10 matched with the protrusion 9. By providing the protrusion 9 and the pressure relief hole 10, the air pressure inside the bottle body 11 can be balanced, which prevents the air pressure from continuously increasing after hot water is poured in, thereby avoiding accidents.

In an embodiment, a bottom of the second bottle component 2 is provided with a detachable silicone fitting ring 13. A side wall of the silicone fitting ring 13 is provided with a locking piece 14 matched with both the bottom and the top of the second bottle component 2. When the silicone fitting ring 13 is disposed on the bottom of the second bottle component 2, the silicone fitting ring 13 is configured to be a base of the second bottle component 2. When the silicone fitting ring 13 is disposed on the top of the second bottle component 2, the silicone fitting ring 13 is configured to be a bottle mouth protective ring of the second bottle component 2. By designing the silicone fitting ring 13 matched with both the bottom and the top of the second bottle component 2, and the silicone fitting ring 13 can be disassembled and assembled through the locking piece 14. When the silicone fitting ring 13 is disposed on the bottom of the second bottle component 2, the silicone fitting ring 13 is configured to be the base of the second bottle component 2. When the silicone fitting ring 13 is disposed on the top of the second bottle component 2, the silicone fitting ring 13 is configured to the bottle mouth protective ring of the second bottle component 2, thereby achieving dual functionality with a single component. It should be noted that the silicone used for the silicone fitting ring 13 is preferably food-grade silicone.

In an embodiment, the locking piece 14 is a third thread structure 141 disposed on the outer side of the silicone fitting ring 13. The third thread structure 141 is matched with the fourth thread structure disposed on an inner side of the bottom of the second bottle component 2, and the third thread structure 141 is matched with a fifth thread structure disposed on an inner side of the top of the second bottle component 2. The silicone fitting ring 13 is locked and unlocked to the second bottle component 2 through the thread structures, which has the advantages of convenient operation and high firmness.

In an embodiment, the locking piece 14 may also be a sixth thread structure disposed on the outer side of the silicone fitting ring 13. The sixth thread structure is matched with a seventh thread structure disposed on the inner side of the bottom of the second bottle component 2, and the sixth thread structure is matched with an eighth thread structure disposed on the inner side of the top of the second bottle component 2.

The disclosure provides a water bottle, which includes a first bottle component 1, at least one second bottle component 2, and a locking mechanism 3. The second bottle component 2 is assembled with the first bottle component 1 in a nested manner, and the locking mechanism 3 is disposed between the first bottle component 1 and the second bottle component 2 for locking or unlocking the first bottle component 1 to the second bottle component 2, thereby forming a combination structure or a separate structure between the first bottle component 1 and the second bottle component 2. By improving the conventional water bottle, a combined structure including the first and second bottle components is obtained. Through the locking mechanism 3 disposed between the first and second bottle components, the water bottle can be used in the form of a combination or a separate structure according to user needs. The advantage of this design is that users can use the water bottle in different scenarios. Especially when the water bottle is in the form of a separate structure, it can be used by multiple people. In scenarios where multiple people do not need to use it, the water bottle can be adjusted to the form of a combination structure, thereby achieving a portable effect.

In the above embodiments, the descriptions of each embodiment focus on different aspects. For parts not detailed in one embodiment, reference can be made to the relevant descriptions in other embodiments.

The above provides a detailed introduction to the water bottle offered by the embodiments of the disclosure. Specific embodiments are used in the specification to illustrate the principles and implementation methods of the disclosure. The explanations of the above embodiments are intended to help understand the technical solutions and core ideas of the disclosure. Those skilled in the art should understand that they can still modify the technical solutions recorded in the above embodiments or replace some technical features with equivalent ones. These modifications or replacements do not cause the essence of the corresponding technical solutions to deviate from the scope of the technical solutions of the embodiments of the disclosure.

What is claimed is:

1. A water bottle, comprising:

a first bottle component, comprising:

a bottle body; and a bottle cover, disposed on a top of the bottle body, wherein the bottle cover is a flip structure, and the bottle cover comprises:

a bottle cover body, wherein a top of the bottle cover body defines an accommodating cavity; and a suction nozzle, rotatably assembled inside the accommodating cavity, wherein the suction nozzle is a hollow structure, and a tail of the suction nozzle is connected to a drinking straw disposed inside the bottle body;

at least one second bottle component, assembled with the first bottle component in a nested manner;

a locking mechanism, disposed between the first bottle component and the at least one second bottle component, wherein the locking mechanism is configured to lock or unlock the first bottle component to the at least one second bottle component, thereby forming a combination structure or a separate structure between the first bottle component and the at least one second bottle component; and a pressing plate, rotatably connected to the bottle cover, wherein an end of the pressing plate is rotatably connected to the suction nozzle, and another end of the pressing plate is detachably connected to an inner wall of the accommodating cavity; when the pressing plate flips towards a direction close to the accommodating cavity, the pressing plate is configured to push the suction nozzle to flip into the accommodating cavity; and a buckle component is disposed between the pressing plate and the accommodating cavity, and the buckle component is configured to lock the pressing plate to the bottle cover; and wherein a supporting plate is disposed on a corresponding position of the suction nozzle connected to the pressing plate, and the supporting plate is configured to support the pressing plate; the supporting plate is provided with a limiting block, the pressing plate defines a first limiting slot and a second limiting slot at intervals, and each of the first limiting slot and the second limiting slot is matched with the limit block; and the first limiting slot is configured to fix the pressing plate when the suction nozzle rotates out of the accommodating cavity, thereby staggering the pressing plate with the suction nozzle, and the second limiting slot is configured to fix the pressing plate when the suction nozzle rotates into the accommodating cavity, thereby making the pressing plate overlap with the suction nozzle.

2. The water bottle as claimed in claim 1, wherein the locking mechanism comprises:

a first thread structure, disposed on an outer side of the first bottle component; and a second thread structure, disposed on an inner side of the at least one second bottle component, corresponding to a position of the first thread structure, and threadedly cooperating with the first thread structure.

3. The water bottle as claimed in claim 1, wherein a protrusion is disposed on a side of the suction nozzle facing towards a bottom of the accommodating cavity, and the bottom of the accommodating cavity defines a through hole connected to the bottle body; and a silicone pad is disposed in the through hole, and the silicone pad defines a pressure relief hole matched with the protrusion.

4. The water bottle as claimed in claim 1, wherein a bottom of the at least one second bottle component is provided with a detachable silicone fitting ring, a side wall of the silicone fitting ring is provided with a locking piece matched with both the bottom and a top of the at least one second bottle component;

wherein when the silicone fitting ring is disposed on the bottom of the at least one second bottle component, the silicone fitting ring is configured to be a base of the at least one second bottle component; and wherein when the silicone fitting ring is disposed on the top of the at least one second bottle component, the silicone fitting ring is configured to be a bottle mouth protective ring of the at least one second bottle component.

* * * * *